US005971944A

United States Patent [19]

Chang

[11] Patent Number: 5,971,944

[45] Date of Patent: Oct. 26, 1999

[54] MASSAGE DEVICE HAVING TWO INDIVIDUALLY DRIVEN MASSAGE MEMBERS

[76] Inventor: Horng Jiun Chang, No. 26-23, Tien Chong Yian Lane, Yuan Lin Town, Chang Hua Hsien, Taiwan

[21] Appl. No.: 09/016,978

[22] Filed: Feb. 2, 1998

[51] Int. Cl.[6] ..... A61H 15/00

[52] U.S. Cl. ..... 601/90; 601/94; 601/99; 601/102; 601/103; 601/111

[58] Field of Search ..... 601/86, 87, 90, 601/92–5, 97–103, 115–6, 118, 107, 108, 110, 111

[56] References Cited

U.S. PATENT DOCUMENTS 4,009,710 3/1977 Inada .
4,615,336 10/1986 Fijimoto .
5,179,940 1/1993 Barreiro .
5,460,598 10/1995 Yamasaki et al. .
5,464,382 11/1995 Wang .

FOREIGN PATENT DOCUMENTS 1400473 7/1975 United Kingdom ..... 601/92

*Primary Examiner*—Danton D. DeMille

[57] ABSTRACT

A massage device includes a shaft and an axle rotatably engaged in a housing and aligned with each other. The shaft has a bevel gear and the axle has a worm gear. Two motors are coupled to the shaft and the axle for driving the shaft and the axle individually. A rod and a pole are rotatably engaged in the housing and each has a bevel gear and a worm gear for engaging with that of the shaft and the axle. Two massage members are coupled to the rod and the pole for allowing the massage members to be actuated individually by the motors.

1 Claim, 3 Drawing Sheets

MASSAGE DEVICE HAVING TWO INDIVIDUALLY DRIVEN MASSAGE MEMBERS

BACKGROUND OF THE INVENTION

1. Field of the Invention

The present invention relates to a massage device, and more particularly to a massage device having two or more massage members that are driven by two or more separated driving mechanisms for allowing the massage members to be operated individually.

2. Description of the Prior Art

Typical massage devices comprise a number of massage members to be rotated or moved for massaging the user. However, the massage members are coupled together by a rather complicated coupling mechanism such that the massage device may not be easily manufactured and assembled and such that the manufacturing cost is greatly increased. In addition, the massage members are coupled together such that the massage members should be driven simultaneously and may not be operated individually.

The present invention has arisen to mitigate and/or obviate the afore-described disadvantages of the conventional massage devices.

SUMMARY OF THE INVENTION

The primary objective of the present invention is to provide a massage device having two or more massage members that are driven by two or more separated driving mechanisms for allowing the massage members to be operated individually.

In accordance with one aspect of the invention, there is provided a massage device comprising a housing including an aperture and two orifices perpendicular to the aperture, the orifices being parallel to each other, a shaft and an axle rotatably engaged in the aperture and aligned with each other, the shaft including a first bevel gear, the axle including a first worm gear, two motor driving means coupling to the shaft and the axle for driving and rotating the shaft and the axle individually, a rod and a pole rotatably engaged in the orifices respectively, the rod including a second bevel gear for engaging with the first bevel gear of the shaft and for allowing the rod to be rotated by the shaft, the pole including a second worm gear for engaging with the first worm gear of the axle and for allowing the pole to be rotated by the axle, and two massage members coupled to the rod and the pole respectively for allowing the massage members to be rotated in concert with the rod and the pole respectively. The massage members are allowed to be actuated individually by the motor driving means such that only one of the massage members may be actuated when required.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
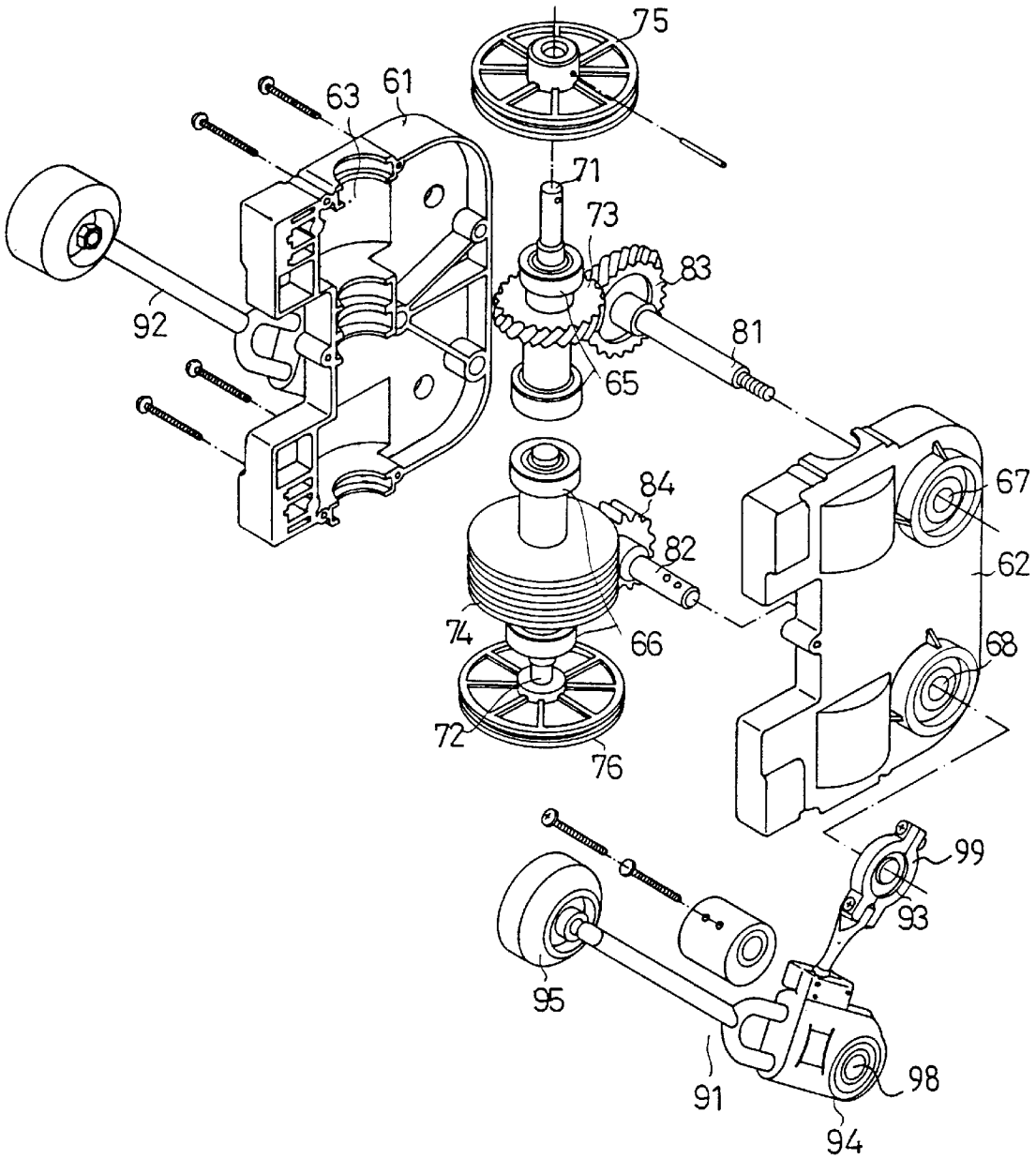
FIG. 1 is an exploded view of a massage device in accordance with the present invention.
Figure 2:
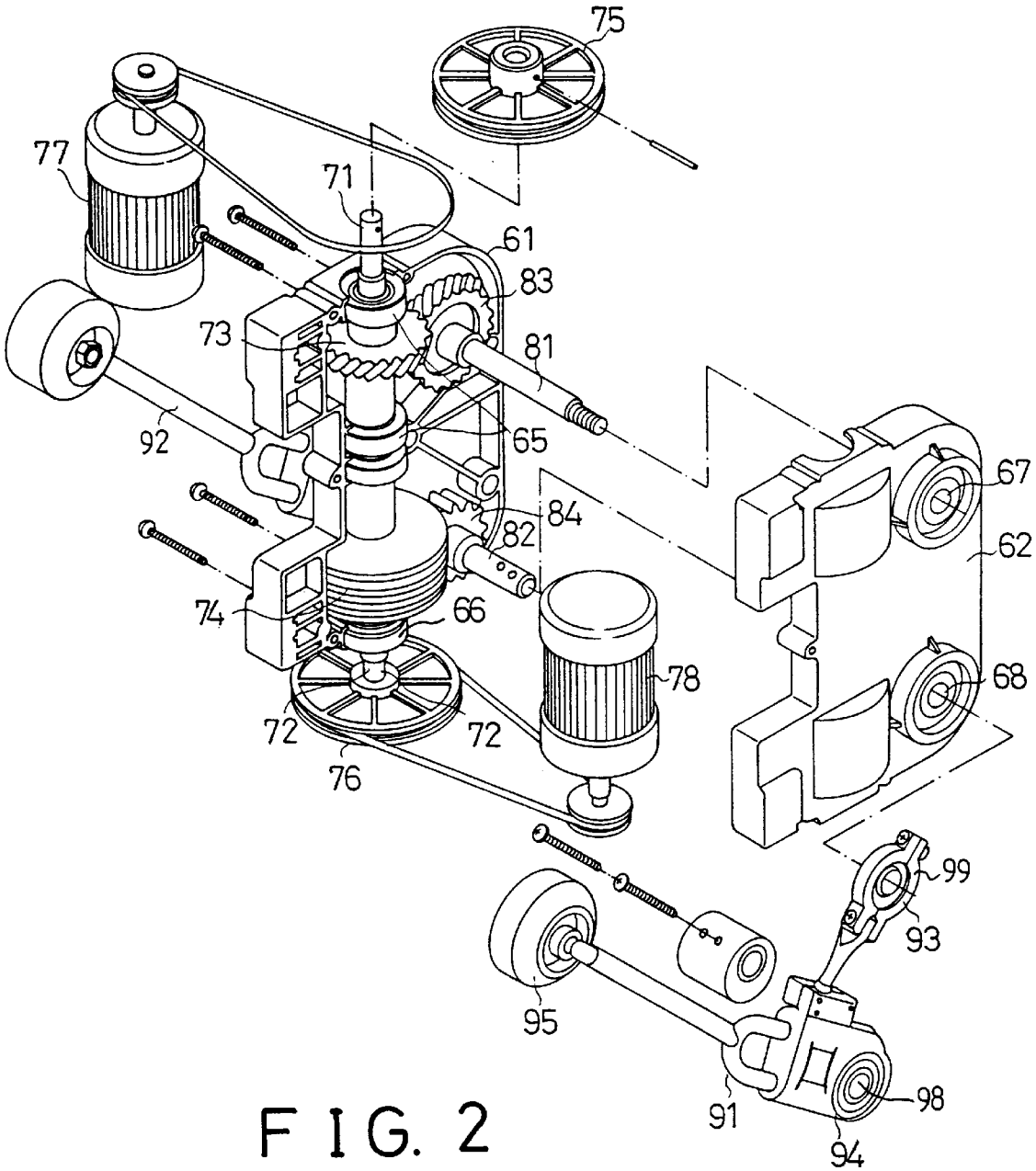
FIG. 2 is a partial exploded view of the massage device.

Referring to the drawings, and initially to FIGS. 1 and 2, a massage device in accordance with the present invention comprises a housing including two halves 61, 62 secured together and including an aperture 63 formed through the housing. A shaft 71 and an axle 72 are rotatably secured in the aperture 63 by bearings 65, 66 and are aligned with each other. The shaft 71 and the axle 72 each has one end extended outward of the housing 61, 62 for securing a wheel 75, 76 respectively. Two motors 77, 78 are coupled to the wheels 75, 76 by belts for rotating the shaft 71 and the axle 72. The shaft 71 includes a bevel gear 73 and the axle 72 includes a worm gear 74.

Figure 3:
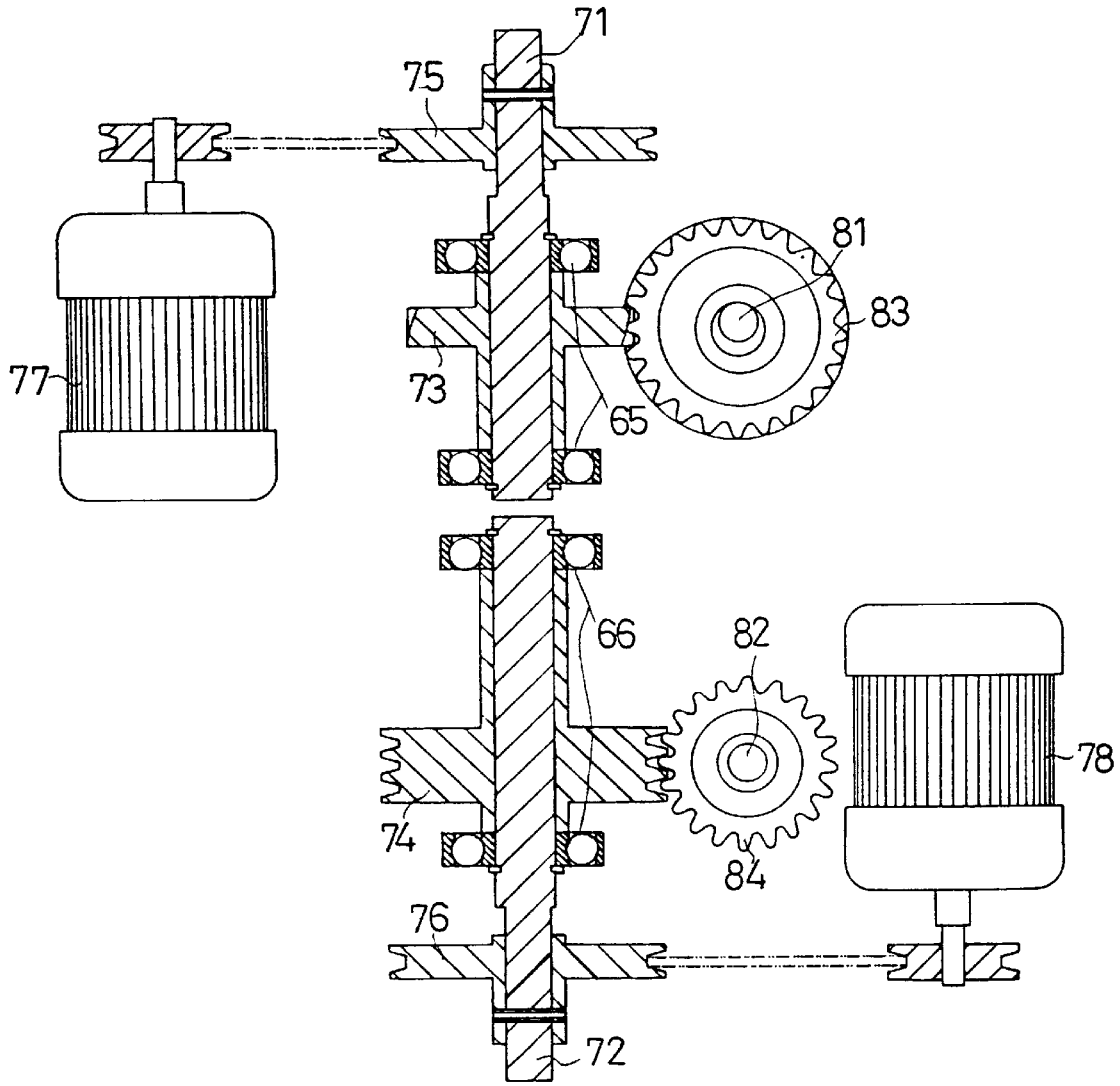
FIG. 3 is a cross sectional view of the massage device.

The housing 61, 62 includes two orifices 67, 68 perpendicular to the aperture 63 and parallel to each other for rotatably engaging with a rod 81 and a pole 82 respectively. The rod 81 includes a bevel gear 83 for engaging with the bevel gear 73 of the shaft 71 and for allowing the motor 77 to drive and to rotate the rod 81. The pole 82 includes a worm gear 84 for engaging with the worm gear 74 of the axle 72 and for allowing the motor 78 to drive and to rotate the pole 82 (FIG. 3).

Two massage members 91, 92 each includes a block 94 rotatably coupled to the housing 61, 62 or rotatably coupled to the other supporting wall members at a pin 98 and each includes a roller 95 for engaging with a user. The massage members 91, 92 each includes a coupler 99 pivotally coupled to a cam 93 that is secured on the rod 81 and the pole 82, for allowing the massage members 91, 92 to be rotated about the pins 98 by the motors 77, 78 via the gears 73, 83; and 74, 84, and the rod 81 and the pole 82 and the cams 93.

It is to be noted that he massage device may include two or more massage members driven by two or more separated driving motors for allowing the massage members to be operated individually. The transmission mechanism engaged in the housing 61, 62 thus includes a greatly simplified configuration, for allowing the massage device to be easily manufactured and assembled. One of the motors may be shut off for allowing only the other motor to be energized and for allowing only one of the massage members to be operated, according to the user's need. Furthermore, the acting directions of the motors may be easily changed or reversed individually.

Accordingly, the massage device in accordance with the present invention includes two or more massage members that are driven by two or more separated driving mechanisms for allowing the massage members to be operated individually.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A massage device comprising:

a housing including an aperture and two orifices perpendicular to said aperture, said orifices being parallel to each other, a shaft and an axle rotatably engaged in said aperture and aligned with each other, said shaft including a first bevel gear, said axle including a first worm gear, two motor driving means coupling to said shaft and said axle for driving and rotating said shaft and said axle individually, a rod and a pole rotatably engaged in said orifices respectively, said rod including a second bevel gear for engaging with said first bevel gear of said shaft and for allowing said rod to be rotated by said shaft, said pole including a second worm gear for engaging with said first worm gear of said axle and for allowing said pole to be rotated by said axle, and two massage members coupled to said rod and said pole respectively for allowing said massage members to be rotated in concert with said rod and said pole respectively, said massage members being allowed to be actuated individually by said motor driving means.

* * * * *